US009570219B2

(12) United States Patent
Natori et al.

(10) Patent No.: US 9,570,219 B2
(45) Date of Patent: Feb. 14, 2017

(54) NON-ORIENTED ELECTRICAL STEEL SHEET AND METHOD OF MANUFACTURING NON-ORIENTED ELECTRICAL STEEL SHEET

(71) Applicant: Nippon Steel & Sumitomo Metal Corporation, Tokyo (JP)

(72) Inventors: Yoshiaki Natori, Tokyo (JP); Kenichi Murakami, Tokyo (JP); Takeaki Wakisaka, Tokyo (JP); Hisashi Mogi, Tokyo (JP); Takuya Matsumoto, Tokyo (JP); Tomoji Shono, Tokyo (JP); Tatsuya Takase, Tokyo (JP); Junichi Takaobushi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 59 days.

(21) Appl. No.: 14/241,543

(22) PCT Filed: Mar. 27, 2013

(86) PCT No.: PCT/JP2013/058999
§ 371 (c)(1),
(2) Date: Feb. 27, 2014

(87) PCT Pub. No.: WO2013/146879
PCT Pub. Date: Oct. 3, 2013

(65) Prior Publication Data

US 2014/0227127 A1 Aug. 14, 2014

(30) Foreign Application Priority Data

Mar. 29, 2012 (JP) ..... 2012-075258

(51) Int. Cl.
*H01F 41/02* (2006.01)
*H01F 1/16* (2006.01)
(Continued)

(52) U.S. Cl.
CPC ..... *H01F 3/02* (2013.01); *C21D 8/1233* (2013.01); *C22C 38/02* (2013.01); *C22C 38/04* (2013.01);
(Continued)

(58) Field of Classification Search
CPC ..... H01F 41/02; H01F 3/02; H01F 1/16; H01F 41/0233; H01F 1/14791; Y10T 29/49986; C21D 8/1233; C22C 38/02; C22C 38/04; C22C 38/06
(Continued)

(56) References Cited

U.S. PATENT DOCUMENTS 5,676,770 A * 10/1997 Sato et al. ..... 148/307
5,803,988 A * 9/1998 Bae ..... C21D 8/1272 148/111
(Continued)

FOREIGN PATENT DOCUMENTS

EP 2031079 A1 3/2009
JP 06-179914 6/1994
(Continued)

OTHER PUBLICATIONS

Kim et al. (WO2012/087045).*
(Continued)

*Primary Examiner* — Jessee Roe
*Assistant Examiner* — John Hevey
(74) *Attorney, Agent, or Firm* — Birch, Stewart, Kolasch & Birch, LLP

(57) ABSTRACT

This oriented electrical steel sheet is a non-oriented electrical steel sheet consisting of, in mass %: C: not less than 0.0001% and not more than 0.0040%, Si: more than 3.0% and not more than 3.7%, sol.Al: not less than 0.3% and not more than 1.0%, Mn: not less than 0.5% and not more than 1.5%, Sn: not less than 0.005% and not more than 0.1%, Ti:
(Continued)

not less than 0.0001% and not more than 0.0030%, S: not less than 0.0001% and not more than 0.0020%, N: not less than 0.0001% and not more than 0.003%, Ni: not less than 0.001% and not more than 0.2%, P: not less than 0.005% and not more than 0.05%, with a balance consisting of Fe and impurities, in which a resistivity ρ at room temperature ≥60 μΩcm, and saturation magnetic flux density Bs at room temperature ≥1.945 T are established, and the components contained satisfy 3.5≤Si+(⅔)×sol.Al+(⅕)×Mn≤4.25.

2 Claims, 1 Drawing Sheet

(51) Int. Cl.

| | |
|---|---|
| ***C21D 8/12*** | (2006.01) |
| ***C22C 38/02*** | (2006.01) |
| ***C22C 38/04*** | (2006.01) |
| ***C22C 38/06*** | (2006.01) |
| ***H01F 3/02*** | (2006.01) |
| *H01F 1/147* | (2006.01) |

(52) U.S. Cl.
CPC ..... *C22C 38/06* (2013.01); *H01F 1/16* (2013.01); *H01F 41/0233* (2013.01); *C21D 8/1222* (2013.01); *C21D 8/1266* (2013.01); *C21D 8/1272* (2013.01); *H01F 1/14791* (2013.01); *Y10T 29/49986* (2015.01)

(58) Field of Classification Search
USPC ..... 420/103; 29/527.4; 148/111, 307, 113
See application file for complete search history.

(56) References Cited

U.S. PATENT DOCUMENTS

| | | | | |
|---|---|---|---|---|
| 7,011,139 | B2 * | 3/2006 | Schoen | C21D 8/1211 164/417 |
| 7,377,986 | B2 * | 5/2008 | Schoen et al. | 148/111 |
| 7,465,364 | B2 * | 12/2008 | Omura et al. | 148/307 |
| 7,763,122 | B2 * | 7/2010 | Bae | C21D 8/1244 148/111 |
| 7,846,271 | B2 * | 12/2010 | Choi | C21D 8/1205 148/111 |
| 7,922,834 | B2 | 4/2011 | Tanaka et al. | |
| 2002/0153063 | A1 * | 10/2002 | Kawamata et al. | 148/111 |
| 2006/0048859 | A1 * | 3/2006 | Omura et al. | 148/226 |
| 2007/0062611 | A1 | 3/2007 | Murakami | |
| 2010/0127125 | A1 * | 5/2010 | Li | B21B 1/227 244/119 |

FOREIGN PATENT DOCUMENTS

| | | | | |
|---|---|---|---|---|
| JP | 08-041603 | | 2/1996 | |
| JP | 10-324957 | | 12/1998 | |
| JP | 2000-129409 | A | 5/2000 | |
| JP | 2001-279398 | A | 10/2001 | |
| JP | 2003-113451 | | 4/2003 | |
| JP | 2008-127612 | | 6/2008 | |
| JP | 2009119496 | | 6/2009 | |
| JP | 2010-185119 | | 8/2010 | |
| WO | 2007/074987 | A1 | 7/2007 | |
| WO | WO2012087045 | * | 6/2012 | C21D 8/12 |

OTHER PUBLICATIONS

International Search Report dated Jul. 2, 2013 issued in corresponding PCT Application No. PCT/JP2013/058999 [with English Translation].
Office Action dated Jan. 15, 2016 issued in corresponding Korean Application No. 1020147007510 [with English Translation].
European Search Report issued on Nov. 18, 2015 in a corresponding European Application No. 13768801.6.

* cited by examiner

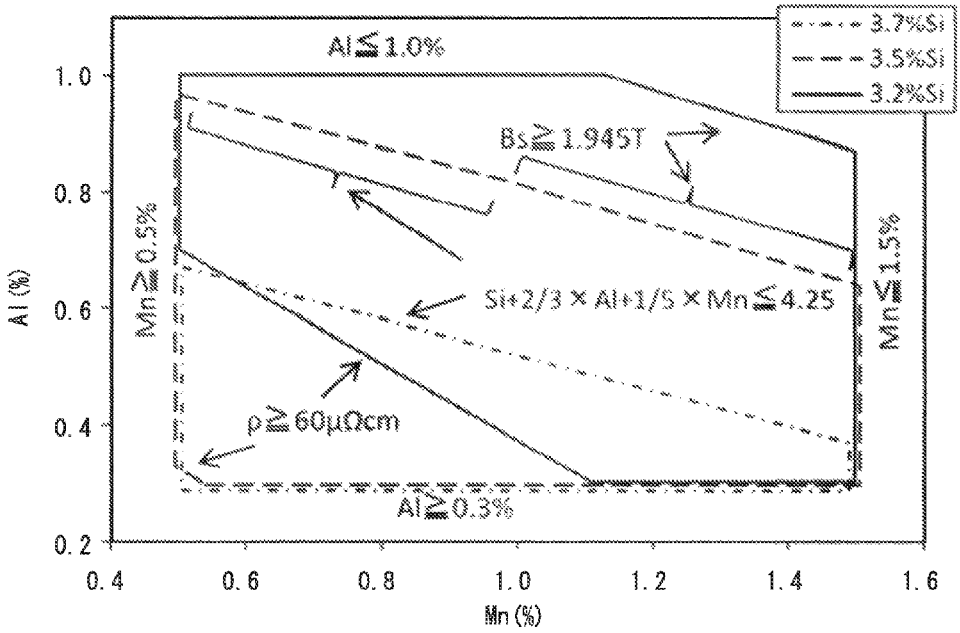
3.7%Si
3.5%Si
3.2%Si
Al≦1.0%
Bs≧1.945T
Mn≧0.5%
Mn≦1.5%
Si+2/3×Al+1/5×Mn≦4.25
ρ≧60μΩcm
Al≧0.3%
Al (%)
Mn (%)
1.0
0.8
0.6
0.4
0.2
0.4
0.6
0.8
1.0
1.2
1.4
1.6

NON-ORIENTED ELECTRICAL STEEL SHEET AND METHOD OF MANUFACTURING NON-ORIENTED ELECTRICAL STEEL SHEET

TECHNICAL FIELD

The present invention relates to a non-oriented electrical steel sheet used as an iron core of a motor for use mainly in, for example, an electric device and a hybrid vehicle, and a method of manufacturing the non-oriented electrical steel sheet. This application is a national stage application of International Application No. PCT/JP2013/058999, filed Mar. 27, 2013, which claims priority to Japanese Patent Application No. 2012-075258 filed in Japan on Mar. 29, 2012, the disclosures of which are incorporated herein by reference in their entirety.

BACKGROUND ART

Due to environmental issues typified by global warming, and resource issues such as the depletion of oil resources and anxiety over nuclear power resources, energy conservation has been increasingly important.

Under such circumstances, the automobile fields, for example, have been making remarkable progress in hybrid vehicles and electric vehicles that contribute to energy conservation.

Further, in the household appliance fields, there is an increasing demand for highly efficient air conditioners and refrigerators that consume less electric power.

These products commonly use motors, and hence, these motors are increasingly required to have improved efficiency.

The motors in these products have been miniaturized in response to the need for miniaturization and weight reduction, and further are designed to rotate at high speeds to meet the need for outputting sufficient power.

In order to reduce increasing losses occurring from high rotational speed and the resulting heat occurring in the devices, cores of the motors are required to be formed by a non-oriented electrical steel sheet having reduced high-frequency iron loss.

Further, these motors need to generate high torque, and there is a demand for the non-oriented electrical steel sheet to have increased saturation magnetic flux density: Bs, especially at the time of motor acceleration.

Since the eddy current loss accounts for a large portion of the iron loss in the high-frequency iron loss, the iron loss can be reduced by increasing the resistivity of the non-oriented electrical steel sheet, as described, for example, in Patent Document 1.

However, alloying, which is necessary to increase the resistivity, brings about a problem of a reduction in the saturation magnetic flux density Bs.

Further, alloying makes the steel sheet significantly brittle, which has a large adverse effect on the productivity.

In particular, if the amount of Si exceeds 3%, the reduction in Bs and brittleness of the steel sheet become notable, which makes it extremely difficult to achieve all the desired magnetic properties and productivity.

In Patent Document 1, the amount of Si+Al is controlled to be less than or equal to 4.5%. However, this control is not sufficient enough to prevent the steel sheet from becoming brittle. Further, Patent Document 1 does not take into consideration the effect of Mn, which is the main point of the present invention.

Yet further, Patent Document 1 does not evaluate Bs, and hence, favorable magnetic property cannot be necessarily obtained.

Patent Document 2 describes making the relationship between resistivity and Bs constant. However, Patent Document 2 is not intended to obtain high torque, and cannot prevent the steel sheet from becoming brittle.

Further, Patent Document 2 is not directed at improving iron loss at high frequencies, and does not take into consideration brittleness of a steel sheet having the amount of Si exceeding 3.0% or improvement in the iron loss of the steel sheet. Thus, favorable magnetic properties cannot be necessarily obtained.

RELATED ART DOCUMENTS

Patent Document

Patent Document 1: Japanese Unexamined Patent Application, First Publication No. H10-324957

Patent Document 2: Japanese Unexamined Patent Application, First Publication No. 2010-185119

DISCLOSURE OF THE INVENTION

Problems to be Solved by the Invention

The present invention is directed to solving the problems that the conventional arts described above have, and provides a non-oriented electrical steel sheet that has reduced iron loss, increased saturation magnetic flux density Bs, and exhibits excellent productivity, and a method of manufacturing the non-oriented electrical steel sheet. More specifically, the present invention provides a non-oriented electrical steel sheet with reduced high-frequency iron loss and increased Bs without causing deterioration in productivity, and a method of manufacturing the non-oriented electrical steel sheet.

Means for Solving the Problem

The main points of the present invention will be described below.

(1) A first aspect of the present invention relates to a non-oriented electrical steel sheet consisting of, in mass %: C: not less than 0.0001% and not more than 0.0040%, Si: more than 3.0% and not more than 3.7%, sol.Al: not less than 0.3% and not more than 1.0%, Mn: not less than 0.5% and not more than 1.5%, Sn: not less than 0.005% and not more than 0.1%, Ti: not less than 0.0001% and not more than 0.0030%, S: not less than 0.0001% and not more than 0.0020%, N: not less than 0.0001% and not more than 0.003%, Ni: not less than 0.001% and not more than 0.2%, and P: not less than 0.005% and not more than 0.05%, with a balance consisting of Fe and impurities, in which a resistivity ρ at room temperature ≥60 μΩcm, and saturation magnetic flux density Bs at room temperature ≥1.945 T are established, and the components contained satisfy $3.5 \leq Si + (2/3) \times sol.Al + (1/5) \times Mn \leq 4.25$.

(2) A second aspect of the present invention relates to a method of manufacturing the non-oriented electrical steel sheet according to (1) described above, including: hot-rolling a slab containing the chemical components specified in (1) described above; after the hot-rolling, applying hot-rolled-sheet annealing or self-annealing, or without applying the hot-rolled-sheet annealing, and applying pickling in either case; applying cold-rolling once, or cold-rolling twice with intermediate annealing applied between applications of cold-rolling; and after the cold-rolling, applying final-annealing, and applying coating, in which, during the cold-rolling, the temperature of a steel sheet at the start of the cold-rolling is set to not less than 50° C. and not more than 200° C., and the rate at which the steel sheet passes through a first pass during rolling is set to not less than 60 m/min and not more than 200 m/min.

Effects of the Invention

According to the present invention, it is possible to provide a non-oriented electrical steel sheet exhibiting reduced high-frequency iron loss and improved saturation magnetic flux density Bs while maintaining high productivity, and a method of manufacturing the non-oriented electrical steel sheet.

The present invention contributes to achieving highly efficient, high-performance motors for use in hybrid vehicles and electric vehicles in the field of automobiles, and in air conditioners and refrigerators in the field of household appliances, and further can maintain high productivity, which makes it possible to achieve reduced manufacturing costs.

BRIEF DESCRIPTION OF THE DRAWINGS

FIG. 1 is a diagram illustrating an example of ranges of components according to the present invention.

EMBODIMENTS OF THE INVENTION

The present inventors made a keen study on elements in a steel sheet and manufacturing conditions to solve the problems described above with regard to providing a non-oriented electrical steel sheet in line with the current tread of motors, in other words, achieving a non-oriented electrical steel sheet with magnetic properties having both sufficiently low high-frequency iron losses and high saturation magnetic flux density Bs in the case where the amount of Si is set to over 3.0%, while, from the viewpoint of manufacturing, the steel sheet maintains its toughness during manufacturing.

As a result, the present inventors revealed that it is possible to prevent deterioration in productivity while maintaining low high-frequency iron loss and high Bs by making the steel contain Si, sol.Al, and Mn in a well-balanced manner.

In particular, for Si, sol.Al, and Mn, the present inventors revealed that the degree of brittleness can be evaluated by using $Si+(2/3)\times sol.Al+(1/5)\times Mn$, and further found that it is possible to alleviate the brittleness and reduce the risk of breakage during the time when the steel sheet is running, by setting this value to not more than 4.25.

Further, the present inventors found that the risk of breakage during the time when the steel sheet is running can be effectively reduced by appropriately controlling temperatures of the steel sheet at the time of running the cold-drawn steel sheet, in addition to setting the chemical components in the range described above.

Below, a non-oriented electrical steel sheet (hereinafter, also referred simply to as a steel sheet) according to an exemplary embodiment of the present invention that has been made on the basis of the findings described above will be described in detail.

First, a reason for limiting the chemical composition of the steel sheet will be described.

It should be noted that "%" and "ppm," each of which indicates the amount of content, mean "mass %" and "mass ppm", respectively, unless otherwise specified.

(C: not less than 0.0001% and not more than 0.0040%)

C causes magnetic aging, which leads to a deterioration in the magnetic properties, and it is desirable to minimize C as much as possible. Thus, C is set to not more than 0.0040%.

The amount of C contained is preferably set to not more than 0.0030%, and more preferably set to not more than 0.0025%.

Further, from the viewpoint of manufacturing load, the lower limit of the amount of C contained is set to 0.0001%, and preferably to 0.0003%.

(Si: more than 3.0% and not more than 3.7%)

Si is an element that increases the resistivity of the electrical steel sheet and effectively reduces the iron loss. Further, Si has an economical advantage of increasing the resistivity at low cost. Thus, it is necessary for Si to exceed 3.0%.

In the case where Si is less than or equal to 3.0%, it is necessary to increase the amount of other expensive elements to obtain the resistivity $\rho \geq 60\ \mu\Omega cm$, and hence, this amount of Si is not desirable.

On the other hand, if the amount of Si added increases, the iron loss can be more effectively reduced. However, an excessive amount of Si added makes the steel sheet brittle, which significantly increases the risk of breakage during manufacturing. Thus, the upper limit of the amount of Si contained is set to 3.7%, and preferably to 3.5%.

(sol.Al: not less than 0.3% and not more than 1.0%)

sol.Al is an element that increases the resistivity of the electrical steel sheet.

However, sol.Al greatly contributes to the reduction in Bs, and has a large effect on the brittleness of the steel sheet. Thus, the upper limit of the amount of sol.Al contained is set to 1.0%, preferably to 0.9%, and more preferably to 0.8%.

Further, in the case where the amount of sol.Al contained is excessively low, the resistivity becomes low. Further, nitrides such as MN finely precipitates, which leads to a deterioration in grain growth. This may worsen the iron loss. Thus, the lower limit of the amount of sol.Al contained is set to 0.3%, preferably to 0.4%, and more preferably to 0.5%.

(Mn: not less than 0.5% and not more than 1.5%)

Mn is an element that increases resistivity of the electrical steel sheet without causing any serious deterioration in the brittleness of the steel sheet, and can effectively reduce the iron loss. Thus, Mn of 0.5% or more is necessary.

If the amount of Mn added is increased, the iron loss can be more effectively reduced. However, Mn causes the formation of austenite, and hence, if the amount of Mn is excessive, the phase is changed from a single phase formed only by ferrite during a high-temperature process in the manufacturing processing, which may significantly deteriorate the magnetic properties of the resulting sheet produced.

For this reason, the upper limit of the amount of Mn contained is set to 1.5%, and preferably to 1.3%.

To reduce the high-frequency iron loss, it is necessary to appropriately adjust the amount of Si, sol.Al, and Mn added.

As a result of study, it was found that it is necessary to set the resistivity at room temperature to not less than 60 $\mu\Omega cm$ to obtain the favorable high-frequency iron loss.

It should be noted that the resistivity at room temperature was obtained through a generally known four-terminal method.

To obtain further favorable motor characteristics, it is necessary to set the saturation magnetic flux density Bs at room temperature to $Bs \geq 1.945$ T.

The saturation magnetic flux density Bs at room temperature itself is an important magnetic property that contributes, for example, to motor torque.

Further, the saturation magnetic flux density Bs at room temperature directly affects the magnetization process, and has an effect on the iron loss. Thus, to obtain favorable iron loss, it is important to design components while taking the saturation magnetic flux density Bs at room temperature into consideration.

To this end, it is desirable to reduce the amount of sol.Al contained that causes a large reduction in Bs, whereas it is desirable to increase the amount of Mn added in view of the necessity to increase the resistivity described above and the influence on brittleness described below.

Bs was measured, for example, through a vibrating sample magnetometer (VSM).

In addition to these, by satisfying $Si+(2/3)\times sol.Al+(1/5)\times Mn \leq 4.25$, it is possible to manufacture a non-oriented electrical steel sheet that exhibits excellent magnetic properties while significantly reducing risks such as breakage during manufacturing, thereby preventing the deterioration in productivity.

Here, Si, sol.Al, and Mn each represent values when contents in the steel sheet are expressed in terms of mass %.

As the value of Si+(⅔)×sol.Al+(⅕)×Mn decreases, the toughness of the steel sheet increasingly improves, and the risk of breakage during the time when the steel sheet is running further reduces.

Thus, from the viewpoint of running the steel sheet, the upper limit of Si+(⅔)×sol.Al+(⅕)×Mn is set preferably to 4.1, and more preferably to 4.0. However, due to the necessity of setting the resistivity at room temperature to not less than 60 μΩcm, it is necessary to appropriately adjust the balance between the amounts of Si, sol.Al, and Mn added. In other words, it is difficult to obtain the desired resistivity if the value of Si+(⅔)×sol.Al+(⅕)×Mn is less than 3.5, and hence, the lower limit value of Si+(⅔)×sol.Al+(⅕)×Mn is set to 3.5, preferably to 3.6, and more preferably to 3.7.

To increase the resistivity while considering the influence on Bs and brittleness as described above, it is desirable to use Mn rather than sol.Al, and it is preferable to satisfy sol.Al<Mn.

Further, it is further preferable to satisfy Mn≥0.7% to sufficiently increase the resistivity.

(Sn: not less than 0.005% and not more than 0.1%)

Sn has an effect of improving texture after final-annealing to improve the B50 (magnetic flux density at the time of magnetization at 5000 A/m), and hence, the amount of Sn contained is set to not less than 0.005%, and preferably 0.01%.

This effect is enhanced with the increase in the amount of Sn added. However, if the amount of Sn contained is 0.1% or more, the effect saturates, and the steel sheet becomes brittle, which increases the risk of breakage at the time when the steel sheet is running. Thus, the upper limit is set to 0.1%, preferably to 0.9%, and more preferably to 0.8%.

(Ti: not less than 0.0001% and not more than 0.0030%)

Ti precipitates in a form of, for example, TiN or TiC, which leads to a deterioration in magnetic properties and grain growth at the time of final-annealing. Thus, it is desirable to reduce Ti as much as possible, and the amount of Ti contained is set to 0.0030% or less, and preferably to 0.0025% or less.

However, from the viewpoint of manufacturing loads, the lower limit of the amount of Ti contained is set to 0.0001%, and preferably to 0.0003%.

(S: not less than 0.0001% and not more than 0.0020%)

S precipitates in a form of, for example, MnS, MgS, TiS, or CuS, which leads to a deterioration in magnetic properties and grain growth at the time of final-annealing. Thus, it is desirable to reduce S as much as possible.

These sulfides are more likely to precipitate in a fine form, and have a large effect on the deterioration in hysteresis loss of the iron loss.

Thus, the amount of S contained is set to not more than 0.0020% or less, and preferably to not more than 0.0015%.

However, from the viewpoint of manufacturing load, the lower limit of the amount of S contained is set to 0.0001%, and preferably to 0.0003%.

(N: not less than 0.0001% and not more than 0.003%)

N precipitates in a form of, for example, TiN or MN, which leads to a deterioration in magnetic properties and grain growth at the time of final-annealing. Thus, it is desirable to reduce N as much as possible.

For this reason, the amount of N contained is set to not more than 0.0030%, and preferably to 0.0025%.

However, from the viewpoint of manufacturing load, the lower limit of the amount of N contained is set to 0.0001%, and preferably to 0.0003%.

As described above, C, Ti, S, and N form precipitates, which leads to an increase in the hysteresis loss.

To reduce the high-frequency iron loss, it is effective to increase the resistivity that lowers the eddy current loss. However, this may cause deterioration in productivity resulting from brittleness as well as deterioration in Bs, which is one of the important magnetic properties.

It is desirable to achieve a sufficiently reduced high-frequency iron loss target while reducing the alloy components as much as possible. Thus, it is preferable to reduce these C, Ti, S, and N as much as possible.

(Ni: not less than 0.001% and not more than 0.2%)

Ni has an effect of improving toughness of the steel sheet to reduce the risk of breakage during manufacturing. Thus, Ni is set to not less than 0.001%.

Ni provides a higher effect with the increase in the amount of Ni added. However, for economic reasons, the upper limit of Ni is set to 0.2%.

(P: not less than 0.005% and not more than 0.05%)

P has an effect of improving texture after final-annealing to improve the B50, and hence, P is set to not less than 0.005%.

This effect is enhanced with the increase in the amount of P added. However, if the amount of P contained exceeds 0.05%, the steel sheet becomes brittle, which increases the risk of breakage at the time when the steel sheet is running Thus, the upper limit is set to 0.05%, and preferably to 0.03%.

The chemical composition of the steel sheet described above contains Fe and impurities as the remainder other than the elements described above. The remainder may only consist of Fe and impurities. The impurities include, for example, O and B, which are inevitable impurities entering during manufacturing processes or other processes, and Cu, Cr, Ca, REM, and Sb, which are very small amounts of elements added for obtaining favorable magnetic properties. These impurities may be contained within a range that does not impair mechanical properties and magnetic properties of the present invention.

An example of the ranges of components according to the present invention is illustrated in FIG. 1.

The portions surrounded by the outlines illustrate appropriate ranges of sol.Al and Mn with the amount of Si added being varied to 3.2%, 3.5%, and 3.7%. Note that portions of the lines overlapping with each other are illustrated so as to be appropriately shifted from each other.

For 3.2% Si illustrated with the solid line, the limitations of 0.3%≤sol.Al≤1.0% and 0.5%≤Mn≤1.5% are applied; the limitation of p≥60μΩcm is applied to the portion where the amounts of sol.Al and Mn are low; and the limitation of Bs≥1.945 T is applied to the portion where the amounts of sol.Al and Mn are large. Thus, the inside of the hexagon surrounded by these lines represents the ranges of the components according to the present invention.

The limitation of components using Si+(⅔)×sol.Al+(⅕)×Mn≤4.25, which is used for evaluating the degree of brittleness, is effective in the case where the amount of Si is high. In the case of 3.7% Si, the inside of the trapezoid surrounded with the dot-and-dash line illustrating the limitations of 0.3%≤sol.Al and 0.5%≤Mn≤1.5% and the limitation of Si+(⅔)×sol.Al+(⅕)×Mn≤4.25 represents the desirable ranges of the components.

In view of the relationship between sol.Al and Mn, there is a slight difference in coefficient between the limitation by Bs≥1.945 T and the limitation by Si+(⅔)×sol.Al+(⅕)×Mn≤4.25. Thus, in the case of 3.5% Si, the inside of the hexagon as illustrated with the dotted line having the crossing point at Mn≈1.0% represents the range of the components according to the present invention for 3.5% Si.

Next, the conditions for manufacturing the steel sheet according to this embodiment will be described.

As a base steel formed by the components described above, it may be possible to use a steel slab produced through melting in a converter and then a continuous casting or ingot-casting primary rolling process.

The steel slab is heated through a known method, and then is subjected to hot-rolling into a hot-rolled sheet having a required thickness.

After this, the hot-rolled sheet is subjected to annealing or self-annealing as necessary.

This hot-rolled sheet is subjected to pickling, and then is cold-rolled, or cold-rolled twice, including intermediate annealing, to form the sheet so as to have a predetermined thickness. Then, the sheet is subjected to final-annealing, and is insulation-coated.

In addition to the manufacturing condition described above, by increasing temperature of the steel sheet at the start of rolling in the cold-rolling and reducing the rate at which the sheet passes through the cold-rolling in the first pass, it is possible to further reduce the risk of breakage during the cold-rolling and the following final-annealing.

The temperature needs to be set to not less than 50° C., and the resulting effect can be enhanced with the increase in the temperature. However, from the viewpoint of the load on facilities, the upper limit of the temperature is set to 200° C.

Further, by setting the rate at which the sheet runs to not more than 200 m/min, the effect of reducing the risk of breakage can be achieved. However, if the rate at which the sheet runs is excessively low, the effect of increasing the temperature of the steel sheet using the heat generated from working processes is significantly reduced, and the effect of reducing the risk of breakage resulting from the increase in the temperature of the steel sheet in the second pass or after is reduced.

In addition, the cost required for rolling significantly increases, and hence, the lower limit of the rate is set to 60 m/min.

It should be noted that the eddy current loss of the iron loss can be more effectively reduced with the reduction in the thickness of the product sheet.

In general, the sheet is manufactured with a thickness of not more than 0.50 mm. However, it is desirable to set the thickness to not more than 0.30 mm to reduce the iron loss, and further, more favorable iron loss can be obtained by setting the thickness to not more than 0.25 mm.

On the other hand, the excessively thin thickness has an adverse effect on the productivity of the steel sheet or increases the cost required for manufacturing motors. Thus, the thickness is set preferably to not less than 0.10 mm, and more preferably to not less than 0.20 mm.

Below, examples of the present invention will be described.

Example 1

Steel slabs containing various components shown in Table 1 adjusted appropriately in a manner such that the steel slabs had a resistivity ρ of approximately 60 μΩcm, with the balance including Fe and inevitable impurities, were prepared. The steel slabs were hot-rolled so as to have a thickness of 2.0 mm, the sheets were subjected to hot-rolled-sheet annealing at 1000° C.×1 minute, pickling, and then cold-rolled so as to have a thickness of 0.30 mm.

It should be noted that, in the first pass of the cold-rolling, the temperature of each of the sheets was set to 70° C., and the rate at which the sheets were run was set to 100 m/min.

The cold-rolled sheets were subjected to final-annealing at 1000° C.×15 seconds, and were insulation-coated.

The magnetism measurement was evaluated using an iron loss (W10/800) obtained at the time when sinusoidal magnetization was performed at a cycle of 800 Hz with the maximum magnetic flux density of 1.0 T.

The existence or absence of breakage was evaluated by judging whether breakage occurred during cold-rolling and final-annealing when three coils were processed.

In all the coils, the values of Si+(⅔)sol.Al+(⅕)Mn were lower than 4.25, and no breakage was found in any of the coils.

However, No. 1 to No. 4 had a resistivity of 60 μΩcm or lower, and as a result, the iron loss W10/800 exceeded 38 W/kg.

No. 5 to No. 12 had a resistivity of 60 μΩcm or higher. However, No. 6 to No. 8 had an iron loss W10/800 exceeding 38 W/kg, and had Bs lower than 1.970 T, exhibiting poor magnetic properties.

One of the reasons that the iron loss was poor relative to the resistivity is considered to be the low Bs, which is another important magnetic property.

In these steel sheets, any one of or both of sol.Al and Mn fell outside the range of the present invention.

On the other hand, No. 5 and No. 9 to No. 12 had an iron loss W10/800 less than or equal to 38 W/kg, and had high Bs more than or equal to 1.970 T, which resulted in excellent magnetic properties having a good balance between iron loss and Bs.

Further, of these samples, No. 9 and No. 12 having sol.Al<Mn and Mn≥0.7% resulted in not more than 37.7 W/kg and Bs of 1.980 T, and exhibited particularly favorable iron loss.

TABLE 1

| No. | C (ppm) | Si (mass %) | sol. Al (mass %) | Mn (mass %) | Sn (mass %) | Ti (ppm) | S (ppm) | N (ppm) | Ni (mass %) | P (mass %) | Resistivity μΩcm | Bs (T) | W10/800 (W/kg) | Si + (2/3)sol. Al + (1/5)Mn | Breakage | Note |
|---|---|---|---|---|---|---|---|---|---|---|---|---|---|---|---|---|
| 1 | 18 | 3.01 | 0.61 | 0.92 | 0.054 | 13 | 17 | 17 | 0.07 | 0.019 | 59.5 | 1.979 | 38.35 | 3.60 | No | Comparative Example |
| 2 | 20 | 3.03 | 0.98 | 0.25 | 0.078 | 15 | 12 | 14 | 0.07 | 0.010 | 59.1 | 1.971 | 38.73 | 3.73 | No | Comparative Example |
| 3 | 23 | 3.38 | 0.35 | 0.53 | 0.066 | 12 | 17 | 16 | 0.06 | 0.014 | 59.0 | 1.986 | 38.21 | 3.72 | No | Comparative Example |
| 4 | 23 | 3.05 | 0.36 | 1.21 | 0.034 | 11 | 17 | 12 | 0.02 | 0.008 | 59.5 | 1.985 | 38.18 | 3.53 | No | Comparative Example |
| 5 | 24 | 3.27 | 0.58 | 0.65 | 0.024 | 16 | 11 | 13 | 0.08 | 0.010 | 60.7 | 1.975 | 37.96 | 3.79 | No | Example of the present invention |
| 6 | 25 | 3.01 | 1.02 | 0.51 | 0.034 | 15 | 7 | 13 | 0.02 | 0.018 | 60.9 | 1.964 | 38.29 | 3.79 | No | Comparative Example |
| 7 | 17 | 3.05 | 1.13 | 0.32 | 0.059 | 16 | 13 | 12 | 0.06 | 0.014 | 61.3 | 1.960 | 38.26 | 3.87 | No | Comparative Example |

TABLE 1-continued

| No. | C (ppm) | Si (mass %) | sol. Al (mass %) | Mn (mass %) | Sn (mass %) | Ti (ppm) | S (ppm) | N (ppm) | Ni (mass %) | P (mass %) | Resistivity μΩcm | Bs (T) | W10/800 (W/kg) | Si + (2/3)sol. Al + (1/5)Mn | Breakage | Note |
|---|---|---|---|---|---|---|---|---|---|---|---|---|---|---|---|---|
| 8 | 26 | 3.23 | 0.93 | 0.21 | 0.026 | 11 | 17 | 16 | 0.06 | 0.013 | 60.8 | 1.966 | 38.20 | 3.89 | No | Comparative Example |
| 9 | 27 | 3.24 | 0.33 | 1.14 | 0.062 | 16 | 12 | 16 | 0.07 | 0.011 | 61.1 | 1.980 | 37.69 | 3.69 | No | Example of the present invention |
| 10 | 24 | 3.26 | 0.71 | 0.52 | 0.047 | 12 | 15 | 15 | 0.03 | 0.008 | 61.0 | 1.971 | 37.97 | 3.84 | No | Example of the present invention |
| 11 | 20 | 3.51 | 0.42 | 0.51 | 0.038 | 16 | 13 | 14 | 0.07 | 0.016 | 61.1 | 1.977 | 37.75 | 3.89 | No | Example of the present invention |
| 12 | 23 | 3.48 | 0.31 | 0.71 | 0.069 | 12 | 16 | 11 | 0.01 | 0.015 | 61.0 | 1.980 | 37.63 | 3.83 | No | Example of the present invention |

Example 2

Steel slabs containing various components shown in Table 2 adjusted appropriately in a manner such that the steel slabs had a resistivity ρ at room temperature of approximately 65 μΩcm, with the balance including Fe and inevitable impurities, were prepared. The steel slabs were hot-rolled so as to have a thickness of 2.0 mm, subjected to hot-rolled-sheet annealing at 1000° C.×1 minute, pickling, and then cold-rolled so as to have a thickness of 0.30 mm. Note that, in the first pass of the cold-rolling, the temperature of each of the sheets was set to 70° C., and the rate at which the sheets were run was set to 100 m/min.

The cold-rolled sheets were subjected to final-annealing at 1000° C.×15 seconds, and were insulation-coated.

The magnetism measurement was evaluated using an iron loss obtained at the time when sinusoidal magnetization was performed at a cycle of 800 Hz with the maximum magnetic flux density of 1.0 T.

The existence or absence of breakage was evaluated by judging whether breakage occurred during cold-rolling and final-annealing when three coils were processed.

No. 15 and No. 19 having the value of Si+(⅔)sol.Al+(⅕)Mn exceeding 4.25 broke in the first pass in cold-rolling, and a large number of small cracks were found on the end surface in the width direction of the cold-rolled coils. Further, some coils broke in the following final-annealing.

Other samples were able to pass through without causing any breakage. No. 14, No. 18, and No. 22 had an iron loss W10/800 exceeding 37.0 W/kg and Bs falling under 1.945 T, which is a criterion according to the present invention.

In the case of these steel sheets, any one of or both of sol.Al and Mn fell outside the range of the present invention.

No. 13, No. 16, No. 17, No. 20, and No. 21 are examples of the present invention, and had a favorable iron loss lower than 37.0 W/kg as well as Bs exceeding 1.945 T, which resulted in both excellent iron loss and Bs.

In particular, No. 13, No. 16, and No. 20 having sol.Al<Mn and Mn≥0.7% resulted in less than 36.6 W/kg and Bs of not less than 1.960 T, and exhibited favorable iron loss.

TABLE 2

| No. | C (ppm) | Si (mass %) | sol. Al (mass %) | Mn (mass %) | Sn (mass %) | Ti (ppm) | S (ppm) | N (ppm) | Ni (mass %) | P (mass %) | Resistivity μΩcm | Bs (T) | W10/800 (W/kg) | Si + (2/3)sol. Al + (1/5)Mn | Breakage | Note |
|---|---|---|---|---|---|---|---|---|---|---|---|---|---|---|---|---|
| 13 | 22 | 3.26 | 0.58 | 1.38 | 0.066 | 16 | 14 | 15 | 0.03 | 0.012 | 65.4 | 1.961 | 36.57 | 3.92 | No | Example of the present invention |
| 14 | 18 | 3.03 | 1.41 | 0.53 | 0.007 | 13 | 9 | 14 | 0.03 | 0.010 | 65.2 | 1.942 | 37.45 | 4.08 | No | Comparative Example |
| 15 | 14 | 3.81 | 0.52 | 0.51 | 0.046 | 14 | 14 | 14 | 0.08 | 0.011 | 65.9 | 1.959 | 36.42 | 4.26 | Exist | Comparative Example |
| 16 | 18 | 3.35 | 0.72 | 0.96 | 0.054 | 16 | 14 | 14 | 0.09 | 0.014 | 65.0 | 1.960 | 36.54 | 4.02 | No | Example of the present invention |
| 17 | 15 | 3.67 | 0.62 | 0.51 | 0.021 | 15 | 10 | 17 | 0.08 | 0.010 | 65.1 | 1.959 | 36.72 | 4.19 | No | Example of the present invention |
| 18 | 15 | 3.20 | 1.18 | 0.67 | 0.063 | 18 | 10 | 16 | 0.10 | 0.012 | 66.0 | 1.944 | 37.05 | 4.12 | No | Comparative Example |
| 19 | 19 | 3.62 | 0.89 | 0.24 | 0.017 | 13 | 10 | 15 | 0.06 | 0.014 | 65.4 | 4.952 | 36.86 | 4.26 | Exist | Comparative Example |
| 20 | 14 | 3.65 | 0.33 | 1.02 | 0.019 | 16 | 13 | 17 | 0.08 | 0.014 | 65.3 | 1.966 | 36.46 | 4.07 | No | Example of the present invention |
| 21 | 14 | 3.65 | 0.64 | 0.52 | 0.046 | 15 | 10 | 15 | 0.07 | 0.008 | 65.1 | 1.959 | 36.74 | 4.18 | No | Example of the present invention |
| 22 | 16 | 3.16 | 1.35 | 0.35 | 0.056 | 18 | 14 | 16 | 0.05 | 0.010 | 65.0 | 1.943 | 37.42 | 4.13 | No | Comparative Example |

Example 3

Steel slabs containing various components shown in Table 3 adjusted appropriately in a manner such that the steel slabs had a resistivity ρ at room temperature of approximately 69 μΩcm, with the balance including Fe and inevitable impurities, were prepared. The steel slabs were hot-rolled so as to have a thickness of 2.0 mm, subjected to hot-rolled-sheet annealing at 1000° C.×1 minute, pickling, and then cold-rolled so as to have a thickness of 0.30 mm.

It should be noted that, in the first pass of the cold-rolling, the temperature of each of the sheets was set to 70° C., and the rate at which the sheets were run was set to 100 m/min.

The cold-rolled sheets were subjected to final-annealing at 1000° C.×15 seconds, and were insulation-coated.

The magnetism measurement was evaluated using an iron loss obtained at the time when sinusoidal magnetization was performed at a cycle of 800 Hz with the maximum magnetic flux density of 1.0 T.

The existence or absence of breakage was evaluated by judging whether breakage occurred during cold-rolling and final-annealing when three coils were processed.

No. 29 to No. 33, and No. 35 having the value of Si+(⅔)sol.Al+(⅕)Mn exceeding 4.25 had a large number of breakages.

prevent breakage, it is understood that it is important to make an evaluation by adding Mn and using Si+(⅔)sol.Al+(⅕)Mn.

Other samples were able to pass through without causing any breakage.

No. 25, No. 26, No. 28, No. 29, No. 32, and No. 33 had an iron loss W10/800 exceeding 36.0 W/kg and Bs lower than 1.945 T, which is a criterion of the present invention.

In No. 25, No. 28, No. 31, and No. 32, sol.Al fell outside the range of the present invention.

No. 26, No. 29, and No. 33 exhibited poor iron losses although attention is paid only to the values of components of Si, sol.Al, and Mn that fell within the range of the present invention.

Bs alone is an important magnetic property, and further, is considered to also have an effect on the iron loss.

Thus, to obtain a favorable iron loss as specified by the present invention, it can be said that it is important to design components while considering not only the ranges of the components but also Bs.

No. 23, No. 24, No. 27, and No. 34 are examples of the present invention, and had a favorable iron loss having W10/800 less than 36.0 W/kg, and having Bs exceeding 1.945 T.

TABLE 3

| No. | C (ppm) | Si (mass %) | sol. Al (mass %) | Mn (mass %) | Sn (mass %) | Ti (ppm) | S (ppm) | N (ppm) | Ni (mass %) | P (mass %) | Resistivity μΩcm | Bs (T) | W10/800 (W/kg) | Si + (2/3)sol. Al + (1/5)Mn | Breakage | Note |
|---|---|---|---|---|---|---|---|---|---|---|---|---|---|---|---|---|
| 23 | 14 | 3.40 | 0.70 | 1.48 | 0.010 | 16 | 8 | 12 | 0.12 | 0.012 | 69.0 | 1.964 | 35.86 | 4.16 | No | Example of the present invention |
| 24 | 13 | 3.55 | 0.61 | 1.34 | 0.045 | 13 | 11 | 10 | 0.10 | 0.010 | 69.0 | 1.948 | 35.74 | 4.22 | No | Example of the present invention |
| 25 | 15 | 3.20 | 1.12 | 1.25 | 0.010 | 11 | 6 | 13 | 0.06 | 0.013 | 69.2 | 1.936 | 36.17 | 4.20 | No | Comparative Example |
| 26 | 13 | 3.41 | 0.91 | 1.13 | 0.044 | 8 | 8 | 10 | 0.11 | 0.011 | 68.9 | 1.941 | 36.03 | 4.24 | No | Comparative Example |
| 27 | 14 | 3.61 | 0.45 | 1.47 | 0.013 | 12 | 8 | 14 | 0.08 | 0.009 | 69.0 | 1.952 | 35.61 | 4.20 | No | Example of the present invention |
| 28 | 11 | 3.05 | 1.50 | 0.90 | 0.009 | 15 | 9 | 13 | 0.11 | 0.011 | 68.8 | 1.928 | 36.58 | 4.23 | No | Comparative Example |
| 29 | 14 | 3.41 | 0.95 | 1.09 | 0.022 | 8 | 6 | 12 | 0.13 | 0.011 | 69.0 | 1.940 | 36.02 | 4.26 | Exist | Comparative Example |
| 30 | 13 | 3.67 | 0.63 | 1.10 | 0.027 | 11 | 7 | 11 | 0.08 | 0.009 | 69.1 | 1.947 | — | 4.31 | Exist | Comparative Example |
| 31 | 11 | 3.03 | 1.84 | 0.42 | 0.018 | 16 | 5 | 13 | 0.06 | 0.008 | 68.8 | 1.920 | — | 4.34 | Exist | Comparative Example |
| 32 | 11 | 3.21 | 1.29 | 0.95 | 0.030 | 12 | 8 | 10 | 0.04 | 0.011 | 69.0 | 1.932 | 36.33 | 4.26 | Exist | Comparative Example |
| 33 | 11 | 3.45 | 0.92 | 1.05 | 0.014 | 15 | 8 | 11 | 0.06 | 0.010 | 69.0 | 1.941 | 36.01 | 4.27 | Exist | Comparative Example |
| 34 | 13 | 3.49 | 0.73 | 1.27 | 0.018 | 15 | 5 | 13 | 0.05 | 0.010 | 69.0 | 1.945 | 35.85 | 4.23 | No | Example of the present invention |
| 35 | 14 | 3.73 | 0.43 | 1.28 | 0.018 | 8 | 9 | 13 | 0.11 | 0.010 | 69.1 | 1.952 | 35.55 | 4.27 | Exist | Comparative Example |

All the breakages occurred in the first pass of the cold-rolling, and a large number of small cracks were found on the end surface in the width direction of the cold-rolled coils. Further, the shape of the cold roll was poor, and some coils broke in the following final-annealing.

In particular, No. 30 and No. 31 had significant brittleness, so that the samples were not able to be repaired after the breakage, and the sheet could not pass through.

No. 30 broke although having almost the same amounts of Si and sol.Al as those in No. 21 in Example 2. Thus, to Example 4

Steel slabs containing C: 0.0012%, Sn: 0.023%, Ti: 0.0011%, S: 0.0007%, N: 0.0014%, Ni: 0.046%, P: 0.011%, Si: 3.26%, sol.Al: 0.98%, and Mn: 0.72% (Si+(⅔)sol.Al+(⅕)Mn=4.06), with the balance including Fe and inevitable impurities, were hot-rolled so as to have a thickness of 2.0 mm. Then, the hot-rolled sheets were subjected to hot-rolled annealing at 1000° C.×1 minute, pickling, and then cold-rolled so as to have a thickness of 0.30 mm.

It should be noted that the cold-rolling was performed while temperatures of each of the sheets and the rate at which the sheets were run were varied in the first pass of the cold-rolling in accordance with the values as shown in Table 4.

The cold-rolled sheets were subjected to final-annealing at 1000° C.×15 seconds, and were insulation-coated.

The existence or absence of breakage was evaluated by judging whether breakage occurred during cold-rolling and final-annealing when three coils were processed.

No. 36 passed through the first pass at a slow rate. Hence, temperatures of the coils were reduced in the second pass, and breakage occurred during the cold-rolling.

No. 41 passed through at a rate faster than the range of the present invention, and breakage occurred during the cold-rolling. Further, the shape of the cold-rolled sheet was poor, and breakage occurred in the following final-annealing.

No. 42 and No. 43 passed through the first pass at temperatures lower than the range of the present invention, and breakage occurred in the first pass during rolling. Further, a large number of small cracks were found on the end surface of the coil in the width direction, and breakage occurred in the following final-annealing.

No. 37 to No. 40 and No. 44 to No. 46 fell within the range of the present invention, and passed through without causing any breakage.

TABLE 4

| No. | Sheet-passing rate in first pass (m/min) | Temperature of sheet passing through first pass (° C.) | Breakage | Note |
|---|---|---|---|---|
| 36 | 50 | 73 | Exist | Comparative Example |
| 37 | 60 | 68 | No | Example of the present invention |
| 38 | 100 | 81 | No | Example of the present invention |
| 39 | 150 | 83 | No | Example of the present invention |
| 40 | 180 | 77 | No | Example of the present invention |
| 41 | 230 | 85 | Exist | Comparative Example |
| 42 | 100 | 31 | Exist | Comparative Example |
| 43 | 100 | 47 | Exist | Comparative Example |
| 44 | 100 | 65 | No | Example of the present invention |
| 45 | 100 | 91 | No | Example of the present invention |
| 46 | 100 | 138 | No | Example of the present invention |

Example 5

Steel slabs containing various components shown in Table 5 adjusted appropriately in a manner such that the steel slabs had a resistivity ρ at room temperature of approximately 69 μΩcm, with the balance including Fe and inevitable impurities, were prepared. The steel slabs were hot-rolled so as to have a thickness of 2.0 mm, the hot-rolled sheets were subjected to pickling without application of hot-rolled-sheet annealing, and then cold-rolled so as to have a thickness of 0.30 mm.

It should be noted that, in the first pass of the cold-rolling, the temperature of each of the sheets was set to 70° C., and the rate at which the sheets were run was set to 100 m/min.

The cold-rolled sheets were subjected to final-annealing with 1050° C.×15 seconds, and were insulation-coated.

The magnetism measurement was evaluated using an iron loss obtained at the time when sinusoidal magnetization was performed at a cycle of 800 Hz with the maximum magnetic flux density of 1.0 T.

The existence or absence of breakage was evaluated by judging whether breakage occurred during cold-rolling and final-annealing when three coils were processed.

No. 50 having the value of Si+(⅔)sol.Al+(⅕)Mn exceeding 4.25 had a large number of breakages.

The breakage occurred in the first pass of the cold-rolling. Further, a large number of small cracks were found on the end surface in the width direction of the cold-rolled coil, and the shape of the cold-rolled sheet was poor.

It can be said that, for the samples without the hot-rolled-sheet annealing, the risk of breakage can be evaluated by setting the value of Si+(⅔)sol.Al+(⅕)Mn to not more than 4.25.

In the case where the hot-rolled-sheet annealing was not applied, the iron loss W10/800 was higher than that of No. 23 to No. 35 that had the hot-rolled-sheet annealing applied thereto, although temperatures during final-annealing were increased to 1050° C.

Of the samples, No. 49 had an iron loss W10/800 higher than 37.0 W/kg and Bs lower than 1.945 T, which is a criterion of the present invention.

In this coil, sol.Al fell outside the range of the present invention.

No. 47 and No. 48 are examples of the present invention and had a favorable iron loss having W10/800 less than 37.0 W/kg and having Bs more than or equal to 1.945 T.

TABLE 5

| No. | C (ppm) | Si (mass %) | sol. Al (mass %) | Mn (mass %) | Sn (mass %) | Ti (ppm) | S (ppm) | N (ppm) | Ni (mass %) | P (mass %) | Resistivity μΩcm | Bs (T) | W10/800 (W/kg) | Si + (2/3)sol. Al + (1/5)Mn | Breakage | Note |
|---|---|---|---|---|---|---|---|---|---|---|---|---|---|---|---|---|
| 47 | 14 | 3.47 | 0.75 | 1.26 | 0.013 | 14 | 12 | 13 | 0.04 | 0.012 | 68.9 | 1.945 | 36.90 | 4.22 | No | Example of the present invention |
| 48 | 11 | 3.63 | 0.45 | 1.41 | 0.042 | 10 | 8 | 13 | 0.12 | 0.011 | 68.9 | 1.952 | 36.64 | 4.21 | No | Example of the present invention |
| 49 | 13 | 3.15 | 1.14 | 1.31 | 0.043 | 11 | 5 | 10 | 0.13 | 0.011 | 69.2 | 1.936 | 37.20 | 4.17 | No | Comparative Example |
| 50 | 11 | 3.44 | 1.02 | 0.91 | 0.041 | 15 | 10 | 10 | 0.11 | 0.007 | 68.9 | 1.938 | 37.10 | 4.30 | Exist | Comparative Example |

INDUSTRIAL APPLICABILITY

According to the present invention, it is possible to provide a non-oriented electrical steel sheet having reduced iron loss and increased saturation magnetic flux density Bs, and exhibiting excellent productivity, and a method of manufacturing the non-oriented electrical steel sheet.

The invention claimed is:

1. A method of manufacturing a non-oriented electrical steel sheet with components consisting of, in mass %:

C: not less than 0.0001% and not more than 0.0040%,
Si: not less than 3.2% and not more than 3.7%,
sol.Al: not less than 0.3% and not more than 1.0%,
Mn: not less than 0.5% and not more than 1.5%,
Sn: not less than 0.005% and not more than 0.1%,
Ti: not less than 0.0001% and not more than 0.0030%,
S: not less than 0.0001% and not more than 0.0020%,
N: not less than 0.0001% and not more than 0.003%,
Ni: not less than 0.001% and not more than 0.2%, and
P: not less than 0.005% and not more than 0.05%, with a balance consisting of Fe and impurities, wherein a resistivity ρ at room temperature ≥60 μΩcm, and saturation magnetic flux density Bs at room temperature ≥1.945 T are established, and the components contained satisfy $3.5 \leq Si+(2/3)\times sol.Al+(1/5)\times Mn \leq 4.25$, the method including:

hot-rolling a slab containing the components;

after the hot-rolling, applying hot-rolled-sheet annealing or self-annealing, or without applying the hot-rolled-sheet annealing, and applying pickling in either case;

applying cold-rolling only once, and after the cold-rolling, applying final-annealing at 1000° C. or more, and applying coating, wherein during the cold-rolling, the temperature of a steel sheet when the cold-rolling starts is set to not less than 50° C. and not more than 138° C., and a rate at which the steel sheet passes through a first pass during rolling is set to not less than 60 m/min and not more than 200 m/min.

2. The method according to claim 1, wherein the non-oriented electrical steel sheet further satisfies sol.Al<Mn.

* * * * *